US008701647B2

(12) United States Patent
LaCroix

(10) Patent No.: US 8,701,647 B2
(45) **Date of Patent: *Apr. 22, 2014**

(54) BLOCK SPLITTER ASSEMBLY AND METHOD OF PRODUCING WALL BLOCKS

(71) Applicant: David M. LaCroix, St. Paul, MN (US)

(72) Inventor: David M. LaCroix, St. Paul, MN (US)

(73) Assignee: Keystone Retaining Wall Systems LLC, West Chester, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/887,844

(22) Filed: May 6, 2013

(65) Prior Publication Data

US 2013/0239941 A1 Sep. 19, 2013

Related U.S. Application Data

(60) Continuation of application No. 13/185,618, filed on Jul. 19, 2011, now Pat. No. 8,448,634, which is a division of application No. 12/133,798, filed on Jun. 5, 2008, now Pat. No. 8,302,591.

(60) Provisional application No. 60/933,309, filed on Jun. 6, 2007.

(51) Int. Cl.
*B28D 1/26* (2006.01)

(52) U.S. Cl.
USPC ..... 125/23.01

(58) Field of Classification Search
USPC ..... 125/23.01
See application file for complete search history.

(56) References Cited

U.S. PATENT DOCUMENTS

| | | | |
|---|---|---|---|
| 1,004,193 | A | 9/1911 | Plaisted |
| 2,881,753 | A | 4/1959 | Entz |
| 2,925,080 | A | 2/1960 | Smith |
| 3,392,719 | A | 7/1968 | Clanton et al. |
| 4,114,773 | A | 9/1978 | Sekiguchi |

(Continued)

FOREIGN PATENT DOCUMENTS

| | | | |
|---|---|---|---|
| EP | 0 294 267 | A1 | 12/1988 |
| GB | 924290 | A | 4/1963 |
| GB | 1 509 747 | A | 5/1978 |
| WO | WO 2004/091879 | A1 | 10/2004 |

OTHER PUBLICATIONS

Sep. 3, 2008 Notification of Transmittal of the International Search Report and the Written Opinion of the International Searching Authority, or the Declaration for counterpart International Application No. PCT/US2008/065921 (16 pages).
Abstract for EP 0 294 267 A1 (2 pages), Dec. 7, 1988.

*Primary Examiner* — Maurina Rachuba
(74) *Attorney, Agent, or Firm* — Popovich, Wiles & O'Connell, P.A.

(57) ABSTRACT

The invention provides a block splitter assembly comprising first lower and second upper opposed splitter blade assemblies. The splitter blade assemblies have a splitting blade and two or more first forming blades. One forming blade is disposed to the right of and one forming blade is disposed to the left of the first splitting blade. The forming blades have forming edges. The splitting blade has a splitting edge that is straight, and the splitting blade has a greater maximum vertical dimension than the maximum vertical dimension of the forming blades. The splitting edge of the first splitting blade is opposed to the splitting edge of the second splitting blade.

24 Claims, 12 Drawing Sheets

(56) References Cited

U.S. PATENT DOCUMENTS

| | | | | |
|---|---|---|---|---|
| 4,250,863 | A | 2/1981 | Gagnon et al. | |
| 6,029,943 | A | 2/2000 | Sievert | |
| 6,050,255 | A * | 4/2000 | Sievert | 125/23.01 |
| 6,082,057 | A * | 7/2000 | Sievert | 52/100 |
| 6,178,704 | B1 | 1/2001 | Sievert | |
| 6,321,740 | B1 | 11/2001 | Scherer et al. | |
| 6,827,073 | B1 * | 12/2004 | Morrell | 125/23.01 |
| 6,874,494 | B2 | 4/2005 | Scherer et al. | |
| 6,886,551 | B2 | 5/2005 | Scherer et al. | |
| 6,910,474 | B1 | 6/2005 | Scherer | |
| 6,918,715 | B2 | 7/2005 | Scherer et al. | |
| 6,964,272 | B2 | 11/2005 | Scherer | |
| 7,004,158 | B2 | 2/2006 | Scherer et al. | |
| 7,066,167 | B2 | 6/2006 | Scherer et al. | |
| 7,146,974 | B2 | 12/2006 | Scherer | |
| 7,428,900 | B2 | 9/2008 | Scherer | |
| 8,448,634 | B2 * | 5/2013 | LaCroix | 125/23.01 |
| 2003/0089363 | A1 | 5/2003 | Suto et al. | |
| 2004/0200468 | A1 | 10/2004 | Scherer et al. | |
| 2005/0268901 | A1 | 12/2005 | Scherer | |
| 2006/0027226 | A1 * | 2/2006 | Sorheim | 125/23.01 |
| 2006/0054154 | A1 * | 3/2006 | Scherer | 125/23.01 |
| 2006/0169270 | A1 | 8/2006 | Scherer et al. | |
| 2008/0047539 | A1 | 2/2008 | Scherer et al. | |
| 2008/0092870 | A1 * | 4/2008 | Karau et al. | 125/23.01 |
| 2008/0096471 | A1 * | 4/2008 | Karau et al. | 451/41 |
| 2008/0135035 | A1 | 6/2008 | Scherer | |

* cited by examiner

BLOCK SPLITTER ASSEMBLY AND METHOD OF PRODUCING WALL BLOCKS

This application is a continuation of U.S. Ser. No. 13/185,618, filed Jul. 19, 2011, which is a divisional of U.S. Ser. No. 12/133,798, filed Jun. 5, 2008, now U.S. Pat. No. 8,302,591 B2, issued Nov. 6, 2012, which claims the benefit of U.S. Provisional Application No. 60/933,309, filed Jun. 6, 2007, entitled "Block Splitter Assembly and Method of Producing Wall Blocks", the contents of each of which are hereby incorporated by reference herein.

FIELD OF THE INVENTION

The invention relates generally to the manufacture of concrete wall blocks. More specifically, it relates to equipment and processes for the creation of faces on concrete wall blocks, especially a block splitter.

BACKGROUND OF THE INVENTION

Retaining walls are used in various landscaping projects and are available in a wide variety of styles. Numerous methods and materials exist for the construction of retaining walls. Such methods include the use of natural stone, poured concrete, precast panels, masonry, and landscape timbers or railroad ties.

A widely accepted method of construction of such walls is to dry stack concrete wall units, or blocks. These blocks are popular because they are mass produced and, consequently, relatively inexpensive. They are structurally sound and easy and relatively inexpensive to install. Because they are made of concrete, they are durable. They can be given a desired appearance such as, for example, natural stone.

Typically, retaining wall blocks are manufactured to have the desired appearance on the front face (i.e., the outer face of a wall) because only the front is visible after the wall is constructed. It is highly desirable to have the front face of the wall system have a natural stone appearance, and many approaches are used in the art to treat or process concrete to evoke the appearance of natural stone, including splitting the block, tumbling the block to weather the face and edges of the face, and using processing or texturing equipment to impart a weathered look to the concrete. Typically, blocks are formed as mirror image pairs joined at a front face which are then subsequently split using a block splitter, as known in the art, to provide a rough appearing front surface on the split blocks.

Automated equipment to split block is well-known, and generally includes a splitting apparatus comprising a supporting table and opposed, hydraulically-actuated splitting blades. A splitting blade is typically a substantial steel plate that is tapered to a relatively narrow or sharp knife edge. The blades typically are arranged so that the knife edges will engage the top and bottom surfaces of the workpiece in a perpendicular relationship with those surfaces, and arranged in a coplanar relationship with each other. In operation, the workpiece is moved onto the supporting table and between the blades. The blades are brought into engagement with the top and bottom surfaces of the workpiece. An increasing force is exerted on each blade, urging the blades towards each other. As the forces on the blades are increased, the workpiece splits (cracks) generally along the plane of alignment of the blades. These machines are useful for the high-speed processing of blocks. They produce an irregular, rock-face finish on the blocks. Because no two faces resulting from this process are identical, the blocks are more natural in appearance than standard, nonsplit blocks.

There is a need for a block splitter assembly that provides a more complex form to the block than the standard block splitters.

SUMMARY OF THE INVENTION

The invention provides a block splitter assembly that provides a more complex form to the block than the standard splitter assembly. The invention provides these more complex forms by using multiple blades to split and form the block.

In particular, the invention provides a block splitter assembly comprising first lower and second upper opposed splitter blade assemblies. The first splitter blade assembly has a single first splitting blade and exactly two first forming blades. One first forming blade is disposed to the right of and one first forming blade is disposed to the left of the first splitting blade. The two first forming blades have forming edges. The first splitting blade has a splitting edge that is straight. The first splitting blade has a greater maximum vertical dimension than the maximum vertical dimension of the two first forming blades. The second splitter blade assembly has a single second splitting blade and exactly two second forming blades. One second forming blade is disposed to the right of and one second forming blade is disposed to the left of the second splitting blade. The two second forming blades have forming edges. The second splitting blade has a splitting edge that is straight. The second splitting blade has a greater maximum vertical dimension than the maximum vertical dimension of the two second forming blades. The splitting edge of the first splitting blade are opposed to the splitting edge of the second splitting blade.

The invention provides a block splitter assembly comprising first lower and second upper opposed splitter blade assemblies. The first splitter blade assembly has a first splitting blade and two first forming blades. One first forming blade is disposed to the right of and one first forming blade is disposed to the left of the first splitting blade. The two first forming blades have forming edges. The first splitting blade has a splitting edge that is straight. The first splitting blade has a greater maximum vertical dimension than the maximum vertical dimension of the two first forming blades. The second splitter blade assembly has a second splitting blade and two second forming blades. One second forming blade is disposed to the right of and one second forming blade is disposed to the left of the second splitting blade. The two second forming blades have forming edges. The second splitting blade has a splitting edge that is straight. The second splitting blade has a greater maximum vertical dimension than the maximum vertical dimension of the two second forming blades. The splitting edge of the first splitting blade is opposed to the splitting edge of the second splitting blade. The forming edges of the first forming blades and the forming edges of the second forming blades are curved.

The invention provides a block splitter assembly comprising first lower and second upper opposed splitter blade assemblies. The lower splitter blade assembly has a lower splitting blade and first, second, and third lower forming blades. The first lower forming blade is disposed to the right of and the second and third lower forming blades are disposed to the left of the lower splitting blade. The lower forming blades have forming edges. The lower splitting blade has a splitting edge that is straight. The lower splitting blade has a greater maximum vertical dimension than the maximum vertical dimension of the lower forming blades. The first, second, and third lower forming blades have longitudinal lengths, and the longitudinal length of the first lower forming blade is equal to or greater than the sum of the longitudinal lengths of the second and third lower forming blades. The upper splitter blade assembly has an upper splitting blade and first, second, and third upper forming blades. The first upper forming blade is disposed to the right of and the second and third upper forming blades are disposed to the left of the upper splitting blade. The upper forming blades have forming edges. The upper splitting blade has a splitting edge that is straight. The upper splitting blade has a greater maximum vertical dimension than the maximum vertical dimension of the upper forming blades. The first, second, and third upper forming blades have longitudinal lengths, and the longitudinal length of the first upper forming blade being equal to or greater than the sum of the longitudinal lengths of the second and third upper forming blades. The splitting edge of the lower splitting blade is opposed to the splitting edge of the lower splitting blade.

The invention provides a splitter blade assembly having a single splitting blade and exactly two forming blades. One forming blade is disposed to the right of and one forming blade is disposed to the left of the splitting blade. The two forming blades have forming edges. The splitting blade has a splitting edge that is straight. The splitting blade has a greater maximum vertical dimension than the maximum vertical dimension of the two forming blades.

The invention provides a splitter blade assembly having a splitting blade and first, second, and third forming blades. The first forming blade is disposed to the right of and the second and third forming blades are disposed to the left of the splitting blade. The forming blades have forming edges. The splitting blade has a splitting edge that is straight. The splitting blade has a greater maximum vertical dimension than the maximum vertical dimension of the forming blades. The first, second, and third forming blades have longitudinal lengths, and the longitudinal length of the first forming blade are equal to or greater than the sum of the longitudinal lengths of the second and third forming blades.

The invention provides a method of producing a concrete block comprising: (i) providing a block splitter assembly comprising first lower and second upper opposed splitter blade assemblies, (ii) placing a concrete workpiece in the block splitter assembly at a splitting position to be engaged by the first and second splitter blade assemblies; and (iii) with the workpiece at the splitting position, activating the first and second splitter blade assemblies to engage the workpiece and thereby split and form the workpiece. The block splitter assembly can be any block splitter assembly described herein.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1:
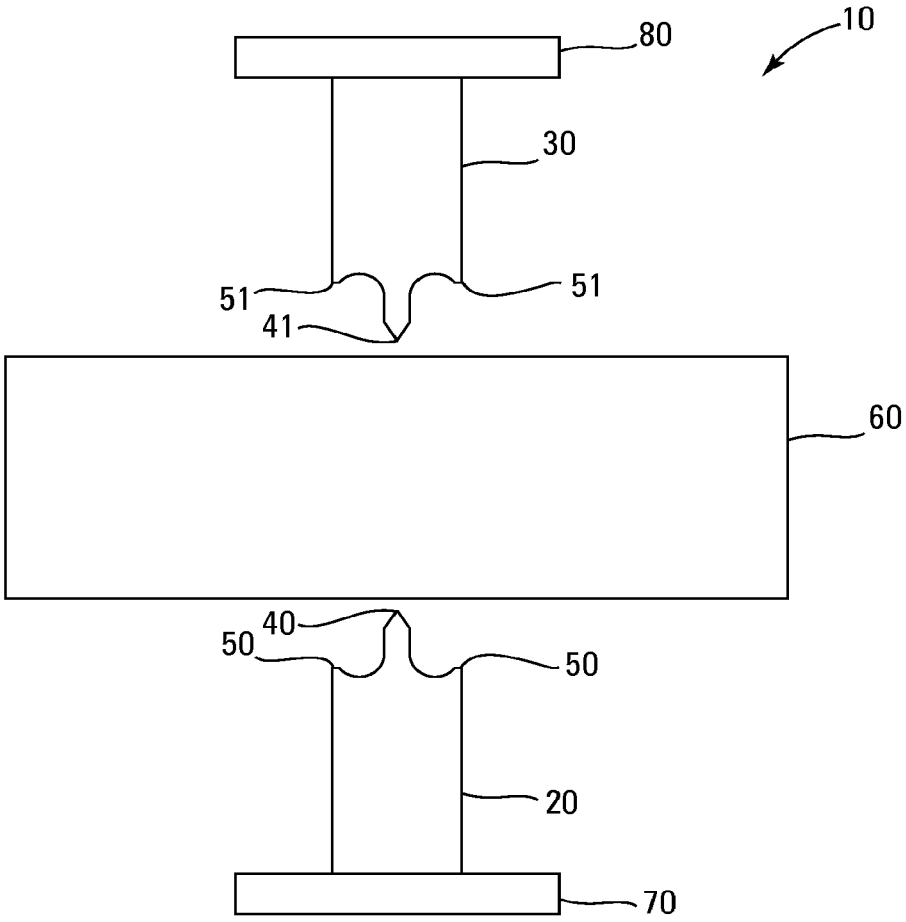
FIG. 1 is an end view of a block splitter assembly of the invention positioned to split a workpiece.

The invention relates to the splitting of concrete wall block workpieces to create a more complex appearance to the faces of concrete retaining wall blocks that result from splitting the workpieces. Block splitter assemblies are described in U.S. Pat. Nos. 6,321,740 B1 and 6,874,494 B2, the contents of each of which are hereby incorporated by reference herein. The invention may be used with any variety of blocks molded or formed through any variety of processes.

The invention provides a block splitter assembly comprising first lower and second upper opposed splitter blade assemblies. The first splitter blade assembly has a single first splitting blade and exactly two first forming blades.

One first forming blade is disposed to the right of and one first forming blade is disposed to the left of the first splitting blade. The two first forming blades have forming edges. The first splitting blade has a splitting edge that is straight. The first splitting blade has a greater maximum vertical dimension than the maximum vertical dimension of the two first forming blades. The second splitter blade assembly has a single second splitting blade and exactly two second forming blades. One second forming blade is disposed to the right of and one second forming blade is disposed to the left of the second splitting blade. The two second forming blades have forming edges. The second splitting blade has a splitting edge that is straight. The second splitting blade has a greater maximum vertical dimension than the maximum vertical dimension of the two second forming blades. The splitting edge of the first splitting blade are opposed to the splitting edge of the second splitting blade.

In one embodiment, the forming edges of the first forming blades are opposed to the forming edges of the second forming blades. In another embodiment, the forming edges of the first forming blades and the forming edges of the second forming blades are curved. In an embodiment, the forming edges of the first forming blades and the forming edges of the second forming blades have ends and the ends curve away horizontally from the first and second splitting blades, respectively. In an embodiment, the forming edges of the first forming blades and the forming edges of the second forming blades are curved in a generally C-shaped curve.

In one embodiment, the first splitting blade and the second splitting blade have longitudinal lengths and the first and second splitting blades have constant vertical dimensions along their longitudinal lengths. In an embodiment, the forming edges of the first forming blades and the forming edges of the second forming blades have ends and midpoints and the ends have greater vertical dimensions than the midpoints. In an embodiment, the forming edges of the first forming blades and the forming edges of the second forming blades are curved vertically in a generally C-shaped curve. In an embodiment, the forming edges of the first forming blades and the forming edges of the second forming blades have ends and the ends curve away horizontally in a generally C-shaped curve from the first and second splitting blades, respectively.

In one embodiment, the first and second opposed splitter blade assemblies are identical except for their opposed orientation. In one embodiment, the first splitting blade and the second splitting blade have a longitudinal length of from 250 mm to 500 mm. In an embodiment, the first splitting blade and the second splitting blade have a longitudinal length of approximately 460 mm. In one embodiment, the first splitting blade, the second splitting blade, and the four first and second forming blades all have the same longitudinal length. In one embodiment, the maximum vertical dimension of the first splitting blade differs from the maximum vertical dimension of the two first forming blades by from 2 mm to 5 mm. In an embodiment, the edges of the two first forming blades are separated by a distance of from 20 mm to 80 mm. In one embodiment, the block splitter assembly further comprises first and second side knife assemblies.

The invention provides a block splitter assembly comprising first lower and second upper opposed splitter blade assemblies. The first splitter blade assembly has a first splitting blade and two first forming blades. One first forming blade is disposed to the right of and one first forming blade is disposed to the left of the first splitting blade. The two first forming blades have forming edges. The first splitting blade has a splitting edge that is straight. The first splitting blade has a greater maximum vertical dimension than the maximum vertical dimension of the two first forming blades. The second splitter blade assembly has a second splitting blade and two second forming blades. One second forming blade is disposed to the right of and one second forming blade is disposed to the left of the second splitting blade. The two second forming blades have forming edges. The second splitting blade has a splitting edge that is straight. The second splitting blade has a greater maximum vertical dimension than the maximum vertical dimension of the two second forming blades. The splitting edge of the first splitting blade is opposed to the splitting edge of the second splitting blade. The forming edges of the first forming blades and the forming edges of the second forming blades are curved.

The invention provides a block splitter assembly comprising first lower and second upper opposed splitter blade assemblies. The lower splitter blade assembly has a lower splitting blade and first, second, and third lower forming blades. The first lower forming blade is disposed to the right of and the second and third lower forming blades are disposed to the left of the lower splitting blade. The lower forming blades have forming edges. The lower splitting blade has a splitting edge that is straight. The lower splitting blade has a greater maximum vertical dimension than the maximum vertical dimension of the lower forming blades. The first, second, and third lower forming blades have longitudinal lengths, and the longitudinal length of the first lower forming blade is equal to or greater than the sum of the longitudinal lengths of the second and third lower forming blades. The upper splitter blade assembly has an upper splitting blade and first, second, and third upper forming blades. The first upper forming blade is disposed to the right of and the second and third upper forming blades are disposed to the left of the upper splitting blade. The upper forming blades have forming edges. The upper splitting blade has a splitting edge that is straight. The upper splitting blade has a greater maximum vertical dimension than the maximum vertical dimension of the upper forming blades. The first, second, and third upper forming blades have longitudinal lengths, and the longitudinal length of the first upper forming blade being equal to or greater than the sum of the longitudinal lengths of the second and third upper forming blades. The splitting edge of the lower splitting blade is opposed to the splitting edge of the lower splitting blade.

In one embodiment, the forming edges of the lower forming blades are opposed to the forming edges of the upper forming blades. In an embodiment, the forming edges of the lower forming blades and the forming edges of the upper forming blades are curved. In one embodiment, the forming edges of the lower forming blades and the forming edges of the upper forming blades have ends and the ends curve away horizontally from the lower and upper splitting blades, respectively. In an embodiment, the forming edges of the lower forming blades and the forming edges of the upper forming blades are curved in a generally C-shaped curve.

In an embodiment, the lower splitting blade and the upper splitting blade have longitudinal lengths and the lower and upper splitting blades have constant vertical dimensions along their longitudinal lengths. In one embodiment, the forming edges of the lower forming blades and the forming edges of the upper forming blades have ends and midpoints and the ends have greater vertical dimensions than the midpoints. In an embodiment, the forming edges of the lower forming blades and the forming edges of the upper forming blades are curved vertically in a generally C-shaped curve. In an embodiment, the forming edges of the lower forming blades and the forming edges of the upper forming blades have ends and the ends curve away horizontally in a generally C-shaped curve from the lower and upper splitting blades, respectively.

In one embodiment, the lower and upper opposed splitter blade assemblies are identical except for their opposed orientation. In an embodiment, the lower splitting blade and the upper splitting blade have a longitudinal length of from 250 mm to 500 mm. In an embodiment, the maximum vertical dimension of the lower splitting blade differs from the maximum vertical dimension of the lower forming blades by from 2 mm to 5 mm. In an embodiment, the block splitter assembly further comprises first and second side knife assemblies.

The invention provides a splitter blade assembly having a single splitting blade and exactly two forming blades. One forming blade is disposed to the right of and one forming blade is disposed to the left of the splitting blade. The two forming blades have forming edges. The splitting blade has a splitting edge that is straight. The splitting blade has a greater maximum vertical dimension than the maximum vertical dimension of the two forming blades.

In one embodiment, the forming edges of the forming blades are curved. In another embodiment, the forming edges of the forming blades have ends and the ends curve away horizontally from the splitting blade. In an embodiment, the forming edges of the forming blades are curved in a generally C-shaped curve.

In one embodiment, splitting blade has a longitudinal length and the splitting blade has a constant vertical dimension along its longitudinal length. In an embodiment, the forming edges of the forming blades have ends and midpoints and the ends have greater vertical dimensions than the midpoints. In an embodiment, the forming edges of the forming blades curved vertically in a generally C-shaped curve. In an embodiment, the forming edges of the forming blades have ends and the ends curve away horizontally in a generally C-shaped curve from the splitting blade.

The invention provides a splitter blade assembly having a splitting blade and first, second, and third forming blades. The first forming blade is disposed to the right of and the second and third forming blades are disposed to the left of the splitting blade. The forming blades have forming edges. The splitting blade has a splitting edge that is straight. The splitting blade has a greater maximum vertical dimension than the maximum vertical dimension of the forming blades. The first, second, and third forming blades have longitudinal lengths, and the longitudinal length of the first forming blade are equal to or greater than the sum of the longitudinal lengths of the second and third forming blades. In an embodiment, the forming edges of the forming blades are curved.

The invention provides a method of producing a concrete block comprising: (i) providing a block splitter assembly comprising first lower and second upper opposed splitter blade assemblies, (ii) placing a concrete workpiece in the block splitter assembly at a splitting position to be engaged by the first and second splitter blade assemblies; and (iii) with the workpiece at the splitting position, activating the first and second splitter blade assemblies to engage the workpiece and thereby split and form the workpiece. The block splitter assembly can be any block splitter assembly described herein. In one embodiment, the block splitter assembly further comprises first and second side knife assemblies and the first and second side knife assemblies engage the workpiece at the same time that the first and second splitter blade assemblies engage the workpiece. In one embodiment, the method splits the workpiece into two blocks and in another embodiment the method splits the workpiece into three blocks.

Turning now to the Figures, the block splitter assemblies and other aspects of this invention are shown and described.

In FIG. 1, a conventional block splitter machine modified in accordance with invention is depicted, in part, showing in particular the block splitter assembly 10. FIG. 1 is an end view of the block splitter assembly 10. Generally, block splitter machines may be obtained from Lithibar Co., located in Holland, Michigan or from other manufacturers. The block splitter assembly generally has opposed first 20 and second 30 splitter blade assemblies. The first or lower splitter blade assembly 20 is positioned at the bottom of the block splitter assembly 10 and, as depicted, includes a first splitting blade 40 and two forming blades 50 positioned on each side of the first splitting blade 40. The first splitter blade assembly 20 is attached to the bottom mounting plate 70 of the block splitter assembly 10.

An upper or second splitter blade assembly 30 may also be seen in FIG. 1. The second splitter blade assembly 30 also includes a second splitting blade 41 and two forming blades 51 positioned on each side of the second splitting blade 41. The second splitter blade assembly 30 is attached to the top mounting plate 80 of the block splitter assembly 10. A workpiece 60 is shown in FIG. 1. The position of the workpiece 60 within the block splitter assembly 10 is shown in FIG. 1 in the ready-to-split position.

Figure 2B:
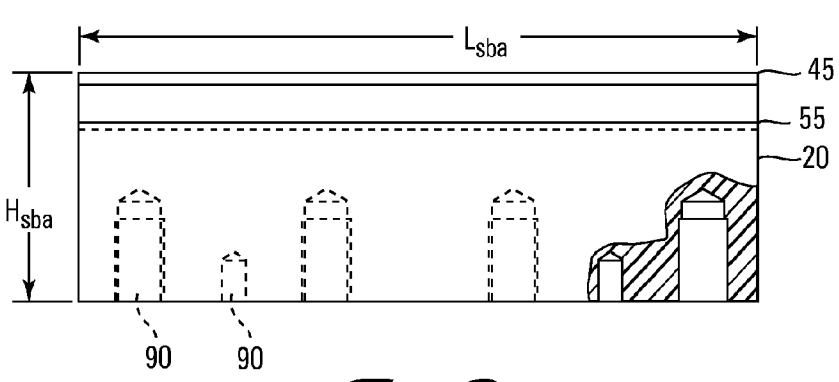
FIG. 2B is a side view of the first splitter blade assembly of FIG. 2.
Figure 2C:
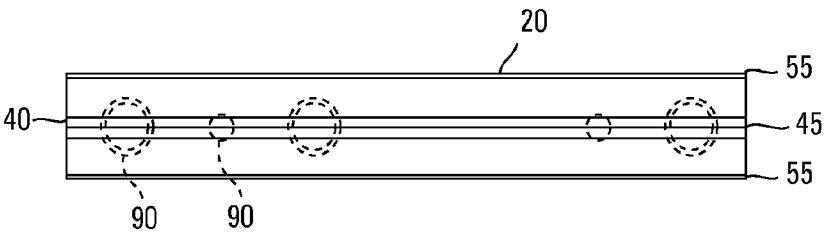
FIG. 2C is a top view of the first splitter blade assembly of FIG. 2.
Figure 2:
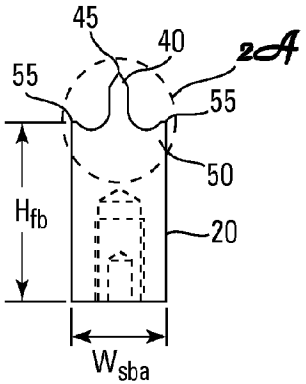
FIG. 2 is an end view of a first splitter blade assembly of FIG. 1.
Figure 2A:
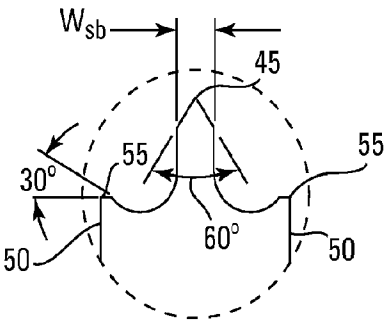
FIG. 2A is an exploded view of a portion of FIG. 2.

FIG. 2 is an end view of the first splitter blade assembly 20. FIG. 2 shows a mounting hole 90 in phantom. Mounting holes 90 are used to mount the first splitter blade assembly 20 to the bottom mounting plate 70 (not shown). FIG. 2A is an exploded view of a portion of FIG. 2 showing the details of the first splitting blade 40 and forming blades 50. FIG. 2B is a side view of the first splitter blade assembly 20. Mounting holes 90 are shown in phantom and the length $L_{sba}$ (for example, 228.6 mm) and height $H_{sba}$ (for example, 69.85 mm) of the first splitter blade assembly 20 are shown. The height of the splitting blade 40 is the same as the height of the first splitter blade assembly ($H_{sba}$). The height $H_{fb}$ of the forming blades 50 (for example, 53.98 mm) is shown in FIG. 2. The forming blades 50 are a distance $W_{sba}$ from each other (for example, 31.75 mm). The edge 45 of the first splitting blade 40 is a distance ($H_{sba}$–$H_{fb}$, for example 15.87 mm) higher than the edges 55 of the forming blades 50. The second splitter blade assembly 30 is identical to the first splitter blade assembly 20 except for its orientation relative to the workpiece 60. FIG. 2C is a top view of the first splitter blade assembly 20.

Figure 3:
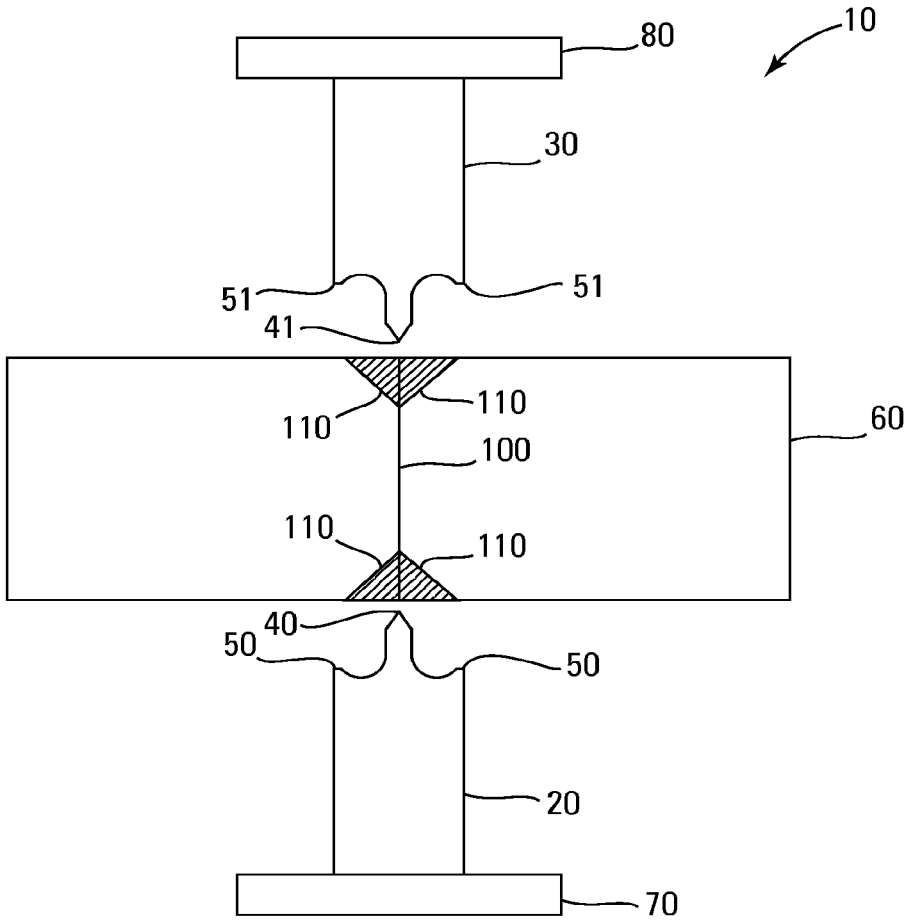
FIG. 3 is an end view of the block splitter assembly of FIG. 1 with the workpiece in the ready-to-split position.
Figure 4:
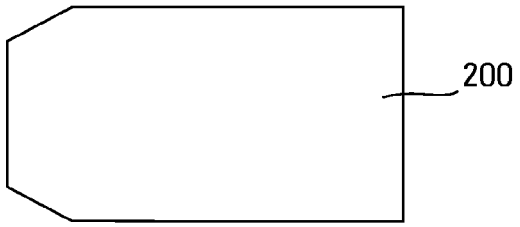
FIG. 4 is a side view of a block produced from the workpiece 60 by the block splitter assembly of FIG. 1.

FIG. 3 is an end view of the block splitter assembly 10 with the workpiece 60 in the ready-to-split position. The workpiece 60 is shown with split line 100 and removed portions 110 (shaded). When the workpiece 60 is split using the block splitter assembly 10, the workpiece breaks along the split line 100, which is produced by the first and second splitting blades 40, 41 and the removed portions 110 are produced by the forming blades 50, 51. FIG. 4 shows a side view of a block 200 produced from the workpiece 60 by the block splitter assembly 10.

In operation, the workpiece 60 is generally centered in the block splitter according to known practices as seen in FIGS. 1 and 3. The block splitter assembly 10 is then activated resulting in the first and second opposing splitter blade assemblies 20, 30 converging on, and striking, the workpiece 60.

In operation, the first and second splitter blade assemblies may travel anywhere from about ⅝ to one inch (1.59 to 2.54 cm) into the top and bottom surfaces of the workpiece 60. Since the splitting blades 40, 41 are ⅝ inch (1.59 cm) higher in the case of splitting blade 40 (or lower in the case of splitting blade 41) than the forming blades 50, 51, the first and second splitter blade assemblies must travel at least this distance into the top and bottom surfaces of the workpiece 60. The workpiece 60 is then split as shown in FIG. 3. However, it is possible and within the scope of the invention to split the workpiece into more than two pieces. Generally, the splitting assemblies act on the block with a pressure ranging from about 600 to 1000 psi (42.2 to 70.3 kg/cm$^2$), and preferably about 750 to 800 psi (52.7 to 56.2 kg/cm$^2$).

Figure 5:
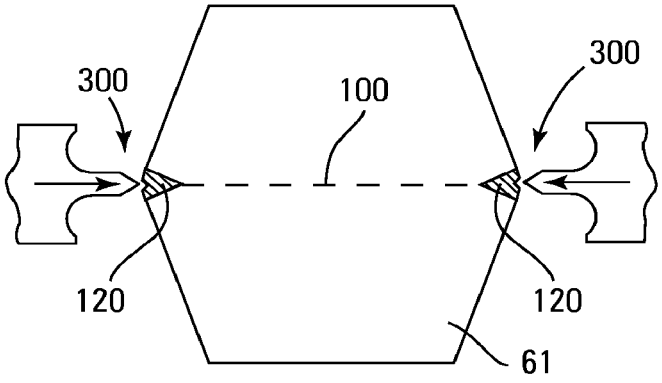
FIG. 5 is a top view of side knife assemblies and a workpiece.

As will be well understood by one of skill in the art, the splitting machine may include opposed hydraulically activated side knife assemblies which preferably impinge upon the block with the same timing and in the same manner as the opposed first and second splitter blade assemblies 20, 30. The side knife assemblies could be formed similarly to the first and second splitter blade assemblies 20, 30 to produce similar removed portions. In addition, variations in the splitter blade assemblies could be used to produce blocks having removed portions on just the top and bottom of the face of a block, the top and bottom and sides, the top and sides, or the sides only. FIG. 5 shows a top view of side knife assemblies 300, removed portions 120, and split line 100 on a workpiece 61.

Figure 6:
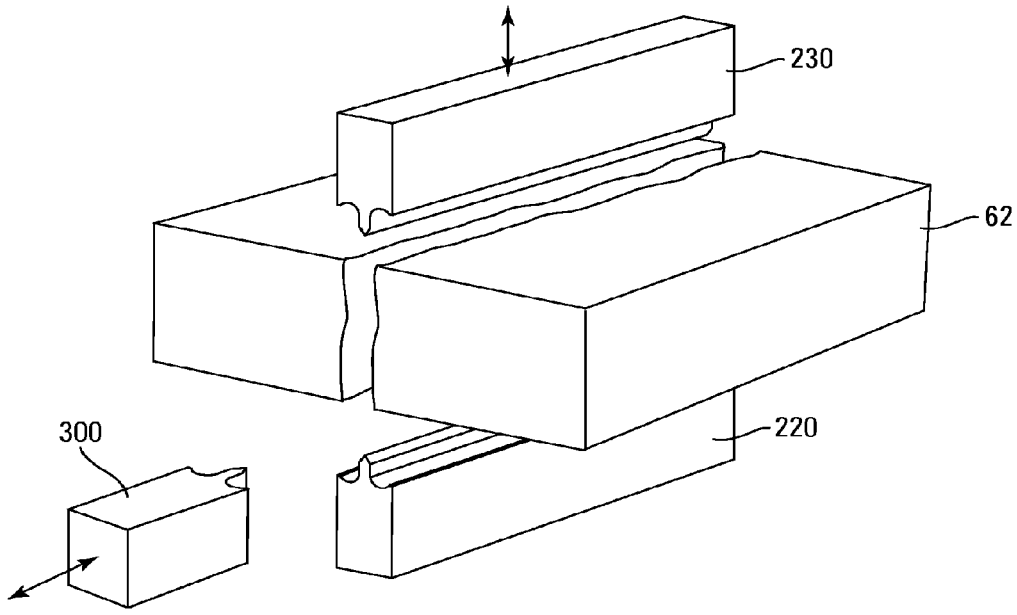
FIG. 6 is a perspective view of a side knife assembly, opposed first lower and second upper splitter blade assemblies, and a workpiece.

FIG. 6 shows a perspective view of a side knife assembly 300, side knife assembly 301 (not shown, opposite side knife assembly 300), opposed first lower and second upper splitter blade assemblies 220, 230, and workpiece 62.

Figure 7:
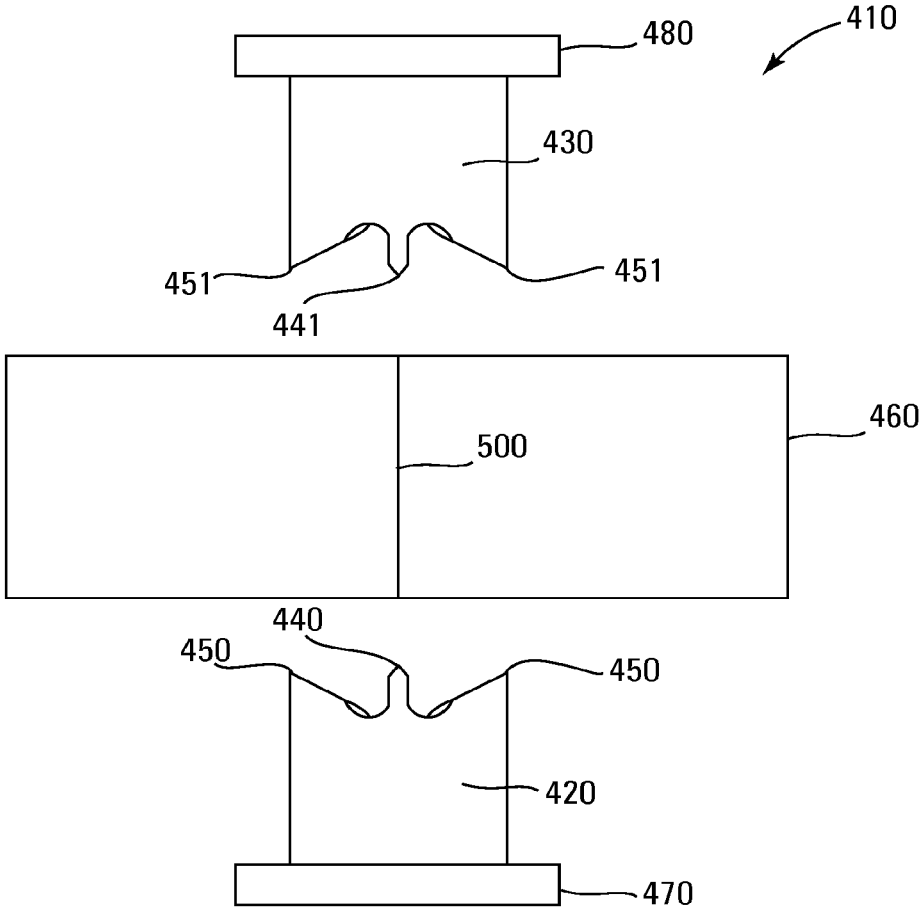
FIG. 7 is an end view of an alternative block splitter assembly of the invention positioned to split a workpiece.

In FIG. 7, a conventional block splitter machine modified in accordance with invention is depicted, in part, showing in particular the alternative block splitter assembly 410. FIG. 7 is an end view of the block splitter assembly 410. The block splitter assembly generally has opposed first 420 and second 430 splitter blade assemblies. The first or lower splitter blade assembly 420 is positioned at the bottom of the block splitter assembly 410 and, as depicted, includes a first splitting blade 440 and two forming blades 450 positioned on each side of the first splitting blade 440. The first splitter blade assembly 420 is attached to the bottom mounting plate 470 of the block splitter assembly 410.

An upper or second splitter blade assembly 430 may also be seen in FIG. 7. The second splitter blade assembly 430 also includes a second splitting blade 441 and two forming blades 451 positioned on each side of the second splitting blade 441. The second splitter blade assembly 430 is attached to the top mounting plate 480 of the block splitter assembly 410. A workpiece 460 is shown in FIG. 7. The position of the workpiece 460 within the block splitter assembly 410 is shown in FIG. 7 in the ready-to-split position.

Figure 8A:
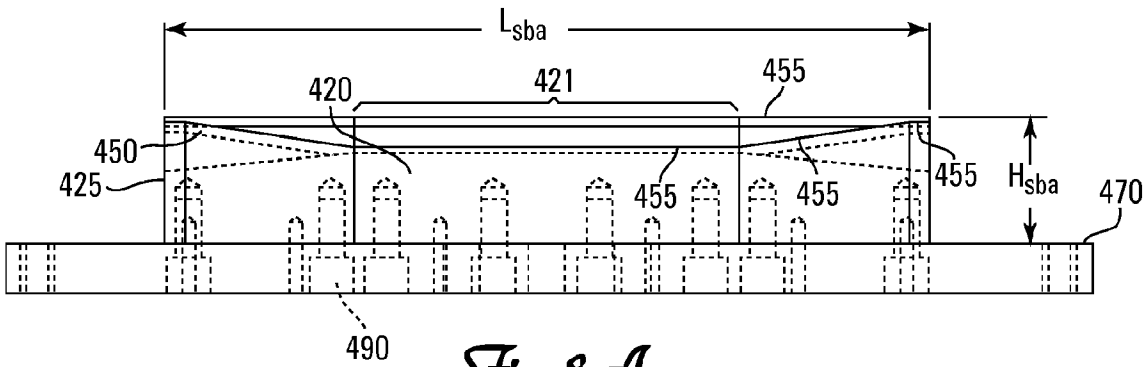
FIG. 8A is a side view of the first splitter blade assembly of FIG. 7.
Figure 8B:
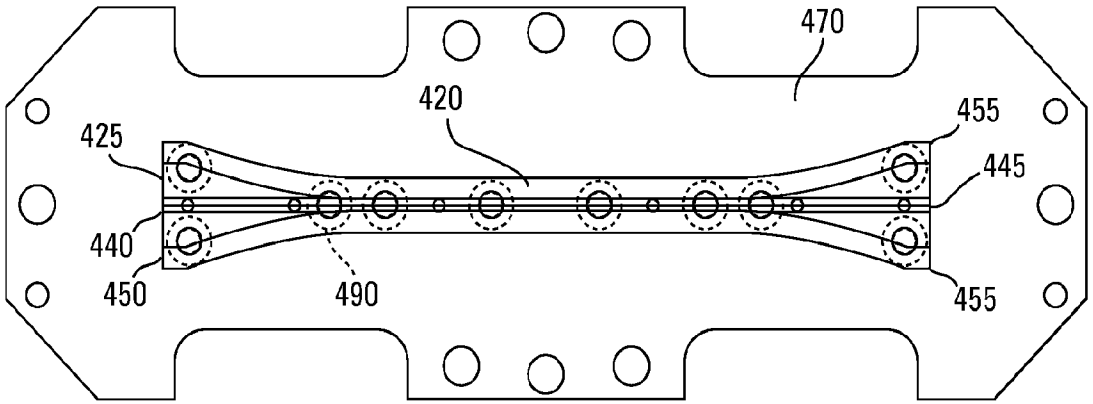
FIG. 8B is a top view of the first splitter blade assembly of FIG. 7.
Figure 8:
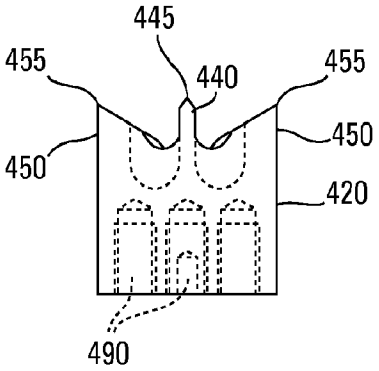
FIG. 8 is an end view of the first splitter blade assembly of FIG. 7.

FIG. 8 is an end view of the first splitter blade assembly 420. FIG. 8 shows mounting holes 490 in phantom, which is used to mount the first splitter blade assembly 420 to the bottom mounting plate 470 (not shown). FIG. 8A is a side view of the first splitter blade assembly 420. Mounting holes 490 are shown in phantom. The length $L_{sba}$ (for example, 457.6 mm) and height $H_{sba}$ (for example, 69.85 mm) of the first splitter blade assembly 420 are shown. Bottom mounting plate 470 is also shown in FIG. 8A. FIG. 8B is a top view of the first splitter blade assembly 420. As shown in FIG. 8B, the edges 455 of the forming blades 450 are closer to the edge 445 of the first splitting blade 440 in the center of the first splitter blade assembly 420 than at the ends 425 of the first splitter blade assembly 420. As shown in FIG. 8A, the edges 455 of the forming blades 450 are lower in the center of the first splitter blade assembly 420 than at the ends of the first splitter blade assembly 420.

Figure 8C:
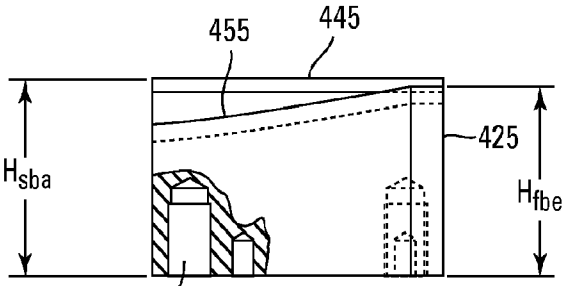
FIG. 8C is a side view of an end portion of the first splitter blade assembly of FIG. 7
Figure 8E:
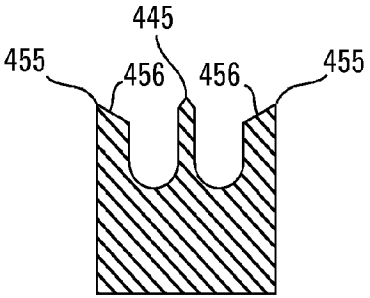
FIG. 8E is a cross-sectional view of the first splitter blade assembly of FIG. 7, with the view taken according to line 8E in FIG. 8D.
Figure 8D:
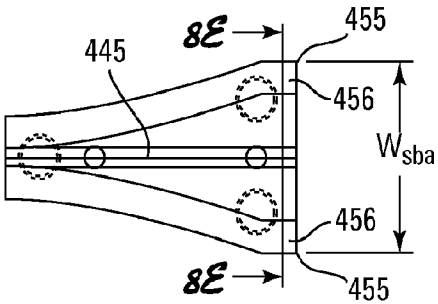
FIG. 8D is a top view of an end portion of the first splitter blade assembly of FIG. 7.

FIG. 8C shows a side view of an end portion of the first splitter blade assembly 420 and FIG. 8D shows a top view of an end portion of the first splitter blade assembly 420. FIG. 8E is a cross-sectional view of the first splitter blade assembly 420, with the view taken according to line 8E in FIG. 8D.

The height of the edge 445 of the first splitting blade 440 is, for example, 69.85 mm, and is the same as the height of the first splitter blade assembly ($H_{sba}$). The height of the edges 455 of the forming blades 450 ($H_{fbe}$) is, for example, 66.68 mm, at the ends 425 of the first splitter blade assembly 420. For example, moving from the ends 425 of the first splitter blade assembly 420 to the center of the assembly 420, the heights of the edges 455 of the forming blades 450 are 66.68 mm from the ends 425 to 12.7 mm from the ends 425, and then the heights decrease gradually from 66.68 to 53.97 mm over the distance from 12.7 mm from the ends to 114.3 mm from the ends.

For example, the edges 455 of the forming blades 450 are 69.85 mm ($W_{sba}$) apart from each other at the ends 425 of the first splitter assembly 420. Moving from the ends 425 of the first splitter blade assembly 420 to the center of the assembly 420, the distance between the edges 455 of the forming blades is 69.85 mm from the ends 425 to 12.7 mm from the ends 425, and then the distance decreases gradually from 69.85 to 31.75 mm over the distance from 12.7 mm from the ends to 114.3 mm from the ends. As shown in FIGS. 8E and 8D, forming blades 450 have crushing surfaces 456. The crushing surfaces 456 crush the workpiece 460 to help to form the block 700. As shown in FIG. 8E, the crushing surface 456 makes an angle of 60 degrees with the vertical axis. Center portion 421 of first splitter blade assembly 420 is identical to first splitter blade assembly 20 shown in FIGS. 2 to 2C.

The second splitter blade assembly 430 is identical to the first splitter blade assembly 420 except for its orientation relative to the workpiece 460.

In alternative embodiments, various dimensions and angles could be changed. For example, the heights of the edges 455 of the forming blades 450 could be 66.68 mm from the ends 425 to 12.7 mm from the ends 425, and then the heights could decrease gradually from 66.68 to 61.91 mm over the distance from 12.7 mm from the ends to 114.3 mm from the ends.

Figure 9:
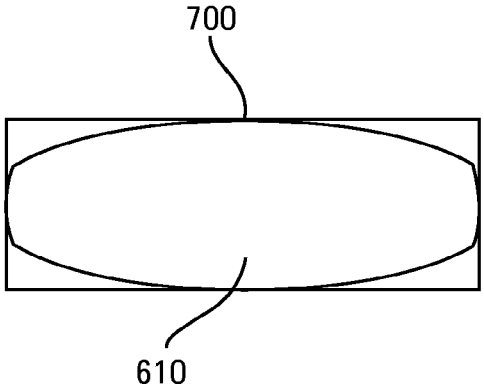
FIG. 9 is a front view of the face of a block produced by the block splitter assembly of FIG. 7.

The block splitter assembly 410 operates similarly to the block splitter assembly 10. FIG. 9 shows the face 610 of a block 700 produced by the block splitter assembly 410. As shown in FIG. 9, the removal of the removed portions 510 (not shown) produces a block having a convex shape. Because of the shape of the forming blades 450, the face is convex along both the x and y axes of the face.

FIG. 7 is an end view of the block splitter assembly 410 with the workpiece 460 in the ready-to-split position. The workpiece 460 is shown with split line 500. When the workpiece 460 is split using the block splitter assembly 410, the workpiece breaks along the split line 500, which is produced by the first and second splitting blades 440, 441 and removed portions (not shown) are produced by the forming blades 450, 451.

In operation, the workpiece 460 is generally centered in the block splitter according to known practices as seen in FIG. 7. The block splitter assembly 410 is then activated resulting in the first and second opposing splitter blade assemblies 420, 430 converging on, and striking, the workpiece 460.

In operation, the first and second splitter blade assemblies may travel anywhere from about ⅝ to one inch (1.59 to 2.54 cm) into the top and bottom surfaces of the workpiece 460. Since the splitting blades 440, 441 are a maximum of ⅝ inch (1.59 cm) higher in the case of splitting blade 440 (or lower in the case of splitting blade 441) than the forming blades 450, 451, the first and second splitter blade assemblies must travel at least this distance into the top and bottom surfaces of the workpiece 460.

It is possible and within the scope of the invention to split the workpiece into more than two pieces. Generally, the splitting assemblies act on the block with a pressure ranging from about 600 to 1000 psi (42.2 to 70.3 kg/cm$^2$), and preferably about 750 to 800 psi (52.7 to 56.2 kg/cm$^2$).

As will be well understood by one of skill in the art, the splitting machine may include opposed hydraulically activated side knife assemblies which impinge upon the block with the same timing and in the same manner as the opposed first and second splitter blade assemblies 420, 430. The side knife assemblies could be formed similarly to the first and second splitter blade assemblies 420, 430 to produce similar removed portions. In addition, variations in the splitter blade assemblies could be used to produce blocks having removed portions on just the top and bottom of the face of a block, the top and bottom and sides, the top and sides, or the sides only. In addition, the heights of and distances between the forming blades and the shapes of the forming blades can be varied to produce different blocks.

Figure 10:
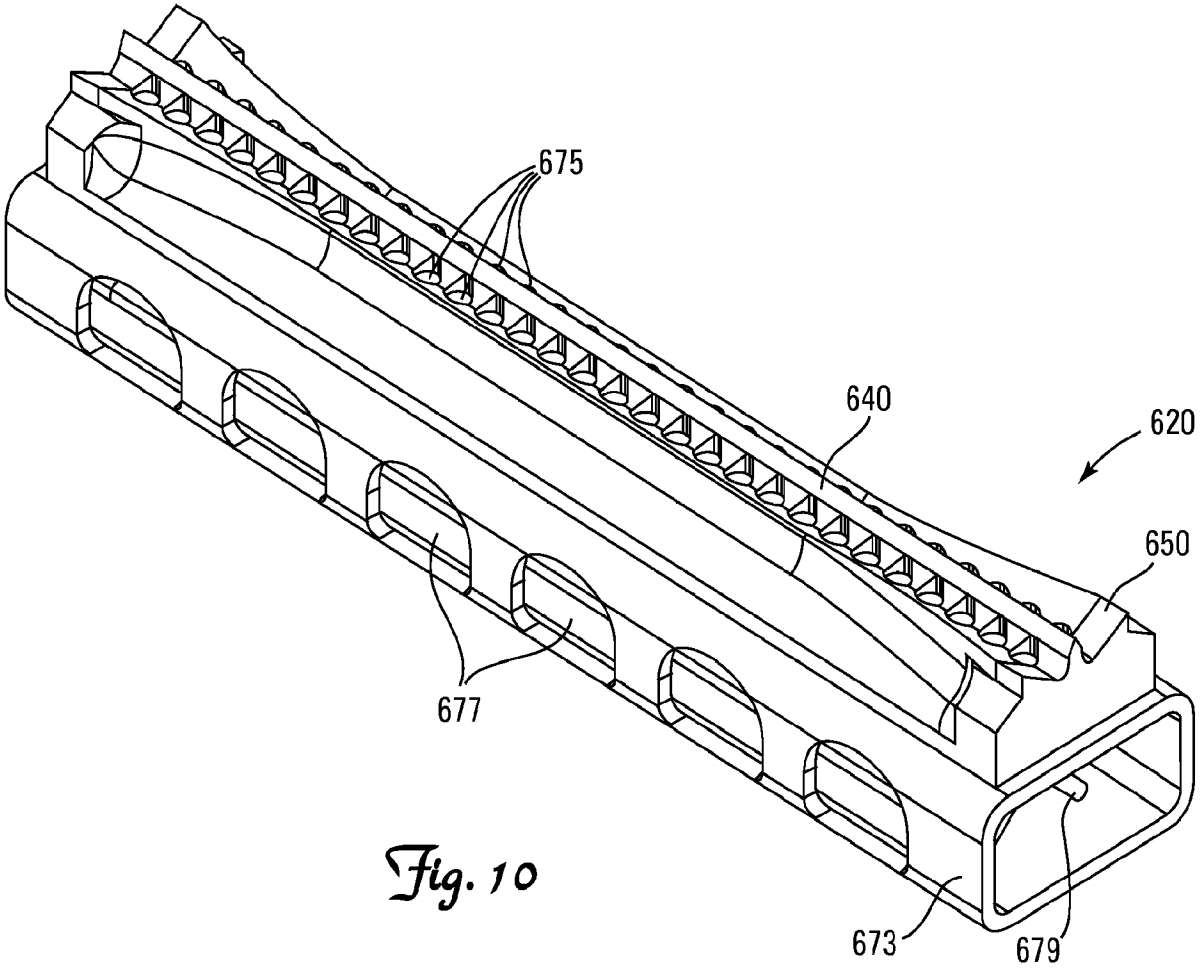
FIG. 10 is a perspective view of an alternative first splitter blade assembly.
Figure 11:
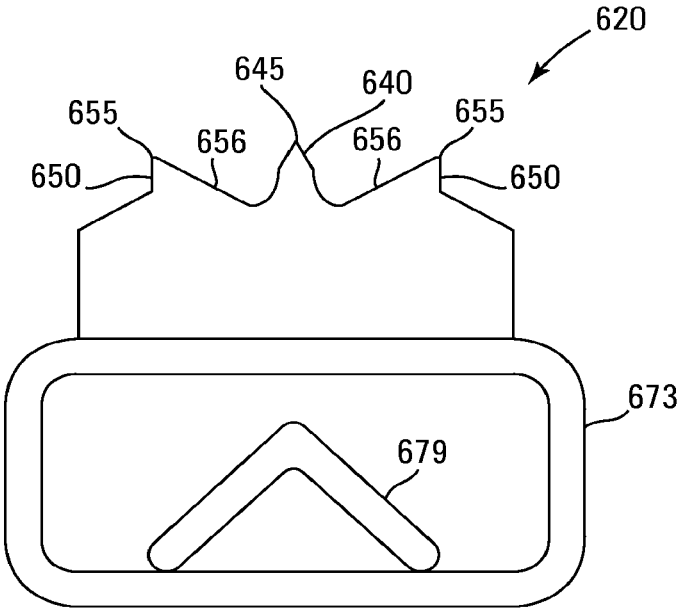
FIG. 11 is a perspective end view of the first splitter blade assembly of FIG. 10.

FIG. 10 is a perspective view of a first splitter blade assembly 620. FIG. 11 is a perspective end view of the first splitter blade assembly 620. First splitter blade assembly 620 has first splitting blade 640 and forming blades 650. Splitting blade 640 has edge 645 and forming blades 650 have edges 655 and crushing surfaces 656.

First splitter blade assembly 620 has a bottom housing 673 beneath the splitting and forming blades. Bottom housing 673 has top holes 675, side holes 677, and a deflector 679. When a workpiece is split, the removed portions can fall through top holes 673 and then through side holes 677. These top and side holes allow the removed portions to fall away from the splitting and forming blades so the removed portions do not impede the process. The deflector 679 helps to send the removed portions out the side holes. The first blade assembly 620 is otherwise somewhat similar to the first blade assembly 420. For example, the length of the first splitting blade is 457.6 mm, the height of the first splitting blade is 69.85 mm as measured from the top of the bottom housing 673, and the width between the edges 655 of the forming blades 650 at the ends of the first blade assembly 620 is 31.75 mm.

Figure 12A:
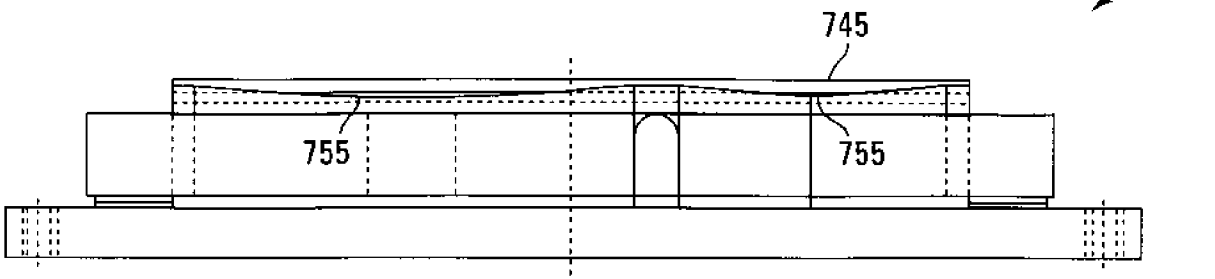
FIG. 12A is a side view of an alternative first splitter blade assembly.
Figure 12B:
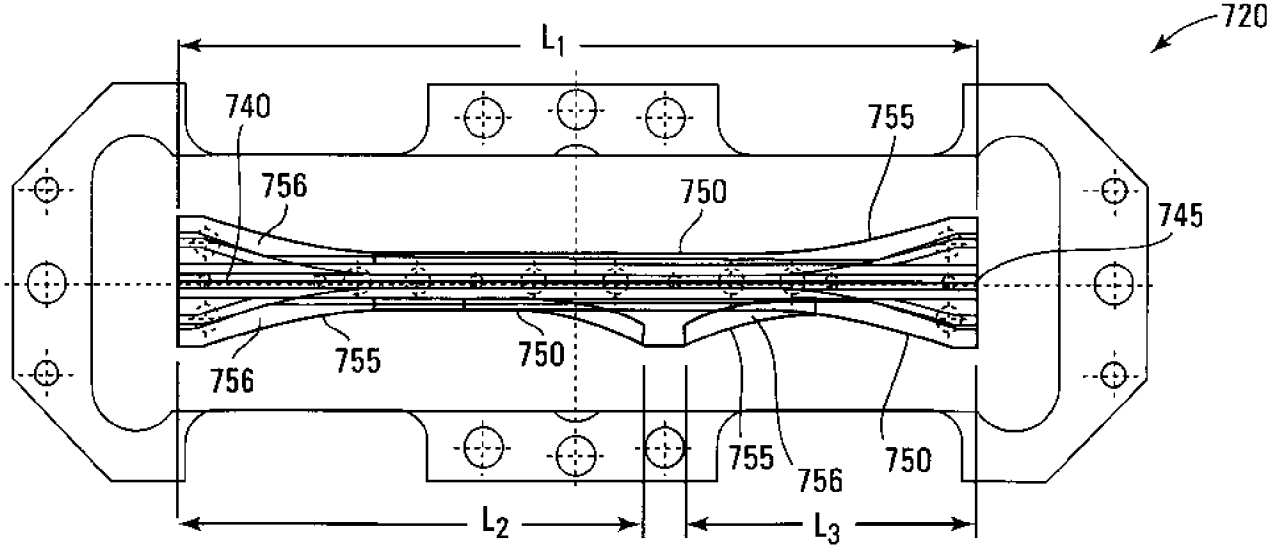
FIG. 12B is a top view of the first splitter blade assembly of FIG. 12A.

FIG. 12A is a side view of a first splitter blade assembly 720. FIG. 12B is a top view of the first splitter blade assembly 720. First splitter blade assembly 720 has first splitting blade 740 and forming blades 750. Splitting blade 740 has edge 745 and forming blades 750 have edges 755 and crushing surfaces 756. The forming blades 750 have longitudinal lengths $L_1$, $L_2$, and $L_3$, as shown. First splitter blade assembly 720 allows the splitting of blocks of varying sizes.

Although particular embodiments have been disclosed herein in detail, this has been done for purposes of illustration only, and is not intended to be limiting with respect to the scope of the following appended claims. In particular, it is contemplated by the inventors that various substitutions, alterations, and modifications may be made to the invention without departing from the spirit and scope of the invention as defined by the claims. For instance, the choices of materials or variations in shapes are believed to be a matter of routine for a person of ordinary skill in the art with knowledge of the embodiments disclosed herein.

What is claimed is:

1. A block splitter assembly comprising first lower and second upper opposed splitter blade assemblies, the first splitter blade assembly having a single first splitting blade and exactly two first forming blades, one first forming blade disposed to the right of and one first forming blade disposed to the left of the first splitting blade, the two first forming blades each having a single forming edge, the first splitting blade having a splitting edge that is straight, at least a first portion of each of the forming edges having a longitudinal length that is straight and parallel to the splitting edge of the first splitting blade and at least a second portion of each of the forming edges having a length that is not parallel to the splitting edge of the first splitting blade, and the first splitting blade having a greater maximum vertical dimension than the maximum vertical dimension of the two first forming blades, the second splitter blade assembly having a single second splitting blade and exactly two second forming blades, one second forming blade disposed to the right of and one second forming blade disposed to the left of the second splitting blade, the two second forming blades each having a single forming edge, the second splitting blade having a splitting edge that is straight, at least a first portion of each of the forming edges having a longitudinal length that is straight and parallel to the splitting edge of the second splitting blade and at least a second portion of each of the forming edges having a length that is not parallel to the splitting edge of the second splitting blade, and the second splitting blade having a greater maximum vertical dimension than the maximum vertical dimension of the two second forming blades, and the splitting edge of the first splitting blade being opposed to the splitting edge of the second splitting blade.

2. The block splitter assembly of claim 1, wherein the forming edges of the first forming blades are opposed to the forming edges of the second forming blades.

3. The block splitter assembly of claim 1, wherein the first splitting blade and the second splitting blade have longitudinal lengths and the first and second splitting blades have constant vertical dimensions along their longitudinal lengths.

4. The block splitter assembly of claim 3, wherein the forming edges of the first forming blades and the forming edges of the second forming blades have end portions and midpoints and the end portions have greater vertical dimensions than the midpoints.

5. The block splitter assembly of claim 4, wherein the end portions of the forming edges of the first forming blades and the end portions of the forming edges of the second forming blades have vertical curves.

6. The block splitter assembly of claim 1, wherein the first and second opposed splitter blade assemblies are identical except for their opposed orientation.

7. The block splitter assembly of claim 1, wherein the first splitting blade and the second splitting blade have a longitudinal length of from 250 mm to 500 mm.

8. The block splitter assembly of claim 7, wherein the first splitting blade and the second splitting blade have a longitudinal length of approximately 460 mm.

9. The block splitter assembly of claim 1, wherein the first splitting blade, the second splitting blade, and the four first and second forming blades all have the same longitudinal length.

10. The block splitter assembly of claim 9, wherein the longitudinal length is from 250 mm to 500 mm.

11. The block splitter assembly of claim 1, wherein the maximum vertical dimension of the first splitting blade differs from the maximum vertical dimension of the two first forming blades by from 2 mm to 5 mm.

12. The block splitter assembly of claim 1, wherein the edges of the two first forming blades are separated by a distance of from 20 mm to 80 mm.

13. The block splitter assembly of claim 1, further comprising first and second side knife assemblies.

14. A splitter blade assembly comprising a single splitting blade and exactly two forming blades, one forming blade disposed to the right of and one forming blade disposed to the left of the splitting blade, the two forming blades each having a single forming edge, the splitting blade having a splitting edge that is straight, at least a first portion of each of the forming edges having a longitudinal length that is straight and parallel to the splitting edge of the splitting blade and at least a second portion of each of the forming edges having a length that is not parallel to the splitting edge of the splitting blade, and the splitting blade having a greater maximum vertical dimension than the maximum vertical dimension of the two forming blades.

15. The splitter blade assembly of claim 14, wherein the splitting blade has a longitudinal length and the splitting blade has a constant vertical dimension along its longitudinal length.

16. The splitter blade assembly of claim 15, wherein the forming edges of the forming blades have end portions and midpoints and the end portions have greater vertical dimensions than the midpoints.

17. The splitter blade assembly of claim 16, wherein the end portions of the forming edges of the forming blades have vertical curves.

18. A method of producing a concrete block comprising:

(i) providing a block splitter assembly comprising first lower and second upper opposed splitter blade assemblies, the first splitter blade assembly having a single first splitting blade and exactly two first forming blades, one first forming blade disposed to the right of and one first forming blade disposed to the left of the first splitting blade, the two first forming blades each having a single forming edge, the first splitting blade having a splitting edge that is straight, at least a first portion of each of the forming edges having a longitudinal length that is straight and parallel to the splitting edge of the first splitting blade and at least a second portion of each of the forming edges having a length that is not parallel to the splitting edge of the first splitting blade, and the first splitting blade having a greater maximum vertical dimension than the maximum vertical dimension of the two first forming blades, the second splitter blade assembly having a single second splitting blade and exactly two second forming blades, one second forming blade disposed to the right of and one second forming blade disposed to the left of the second splitting blade, the two second forming blades each having a single forming edge, the second splitting blade having a splitting edge that is straight, at least a first portion of each of the forming edges having a longitudinal length that is straight and parallel to the splitting edge of the second splitting blade and at least a second portion of each of the forming edges having a length that is not parallel to the splitting edge of the second splitting blade, and the second splitting blade having a greater maximum vertical dimension than the maximum vertical dimension of the two second forming blades, and the splitting edge of the first splitting blade being opposed to the splitting edge of the second splitting blade;

(ii) placing a concrete workpiece in the block splitter assembly at a splitting position to be engaged by the first and second splitter blade assemblies; and (iii) with the workpiece at the splitting position, activating the first and second splitter blade assemblies to engage the workpiece and thereby split and form the workpiece.

19. The method of claim 18, wherein the forming edges of the first forming blades are opposed to the forming edges of the second forming blades.

20. The method of claim 18, wherein the first splitting blade and the second splitting blade have longitudinal lengths and the first and second splitting blades have constant vertical dimensions along their longitudinal lengths.

21. The method of claim 20, wherein the forming edges of the first forming blades and the forming edges of the second forming blades have end portions and midpoints and the end portions have greater vertical dimensions than the midpoints.

22. The method of claim 21, wherein the end portions of the forming edges of the first forming blades and the end portions of the forming edges of the second forming blades have vertical curves.

23. The method of claim 18, wherein the first and second opposed splitter blade assemblies are identical except for their opposed orientation.

24. The method of claim 18, wherein the block splitter assembly further comprises first and second side knife assemblies and the first and second side knife assemblies engage the workpiece at the same time that the first and second splitter blade assemblies engage the workpiece.

* * * * *